US006811243B2

(12) United States Patent
Pearlstine et al.

(10) Patent No.: US 6,811,243 B2
(45) Date of Patent: Nov. 2, 2004

(54) PRIMING FLUID FOR INK JET PRINTHEADS

(75) Inventors: Kathryn A. Pearlstine, Chadds Ford, PA (US); Waifong Liew Anton, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 93 days.

(21) Appl. No.: 10/264,000

(22) Filed: Oct. 3, 2002

(65) Prior Publication Data

US 2003/0117472 A1 Jun. 26, 2003

Related U.S. Application Data

(60) Provisional application No. 60/327,416, filed on Oct. 5, 2001.

(51) Int. Cl.[7] ..... B41J 2/165
(52) U.S. Cl. ..... 347/28
(58) Field of Search ..... 347/28, 29, 30, 347/100; 510/289, 357, 421

(56) References Cited

U.S. PATENT DOCUMENTS

| | | | | |
|---|---|---|---|---|
| 4,232,702 | A | | 11/1980 | Geil |
| 4,272,772 | A | | 6/1981 | Geil |
| 4,305,701 | A | | 12/1981 | Geil |
| 5,475,141 | A | * | 12/1995 | Kos et al. ..... 564/473 |
| 5,500,659 | A | | 3/1996 | Curran, Jr. et al. |
| 5,518,534 | A | | 5/1996 | Pearlstine et al. |
| 5,555,008 | A | | 9/1996 | Stoffel et al. |
| 5,917,512 | A | * | 6/1999 | Weber et al. ..... 347/28 |
| 5,939,182 | A | * | 8/1999 | Huang et al. ..... 428/323 |
| 6,135,656 | A | | 10/2000 | Kato et al. |
| 6,142,601 | A | | 11/2000 | Sharma et al. |
| 6,174,052 | B1 | | 1/2001 | Eremity et al. |
| 6,183,058 | B1 | | 2/2001 | Sharma et al. |
| 6,450,632 | B1 | * | 9/2002 | Tsang et al. ..... 347/96 |

* cited by examiner

*Primary Examiner*—Shih-Wen Hsieh
(74) *Attorney, Agent, or Firm*—Bart E. Lerman

(57) ABSTRACT

This invention relates to the use of a priming fluid in ink jet printers and in particular, to the use of an aqueous priming fluid used in conjunction with aqueous based ink jet inks in ink jet printers using ink jet printheads, such as, piezo ink jet printer heads.

20 Claims, No Drawings

PRIMING FLUID FOR INK JET PRINTHEADS

CROSS-REFERENCE TO RELATED APPLICATION

This application claims priority under 35 U.S.C. §119 from U.S. Provisional Application Ser. No. 60/327,416 (filed Oct. 5, 2001), which is incorporated by reference herein as if fully set forth.

BACKGROUND OF THE INVENTION

This invention relates to the use of a priming fluid in ink jet printers and in particular, to the use of an aqueous priming fluid used in conjunction with aqueous based ink jet inks in ink jet printers using ink jet printheads, such as, piezo ink jet printheads.

In a typical ink jet printer, ink is passed from a reservoir to an ink jet printhead and then is printed onto a substrate that typically is a sheet of paper, vinyl, cardboard, or a woven or a non-woven fabric. At the start of the printing process, when the dry ink jet printhead is initially filled with ink, problems often occur. The ink does not adequately wet the walls and passageways in the ink jet printhead. This is a particular problem with piezo ink jet printheads. If there is inadequate wetting of the surfaces in the printhead, air bubbles will be entrapped in the ink and, on firing of the printhead, ink will not be applied causing skips in printing and irregular printing until the ink fully wets the interior of the printing head; then the ink is applied uniformly.

There is a particular problem with printheads used in industrial applications as opposed to printheads used in desk top printers since the inks in such industrial applications are of a higher viscosity and the printheads are made of metals, such as stainless steel, nickel or aluminum, and ceramic components, that are more difficult to wet in comparison to the printheads used in desk top printer applications.

It is possible to formulate inks that will sufficiently wet the interior of a printhead and any related components; however, such inks will in general have problems maintaining their firing characteristics over a long term. Inks that wet the printhead and related components also wet the surface nozzle plate of the printhead during printing. The result is pooling or puddling of ink around the nozzle outlets which leads to misdirection of the ink drops being fired from the printhead during printing. Also, inks that are formulated to have good wetting characteristics often contain high levels of organic components and/or surfactants that are incompatible with other requirements of the ink, such as long term stability, firing consistency, and quality printing of the ink on a substrate. For these reasons, a formulation that meets all of the requirements of an aqueous ink jet ink is in general not useful as a priming fluid.

A process and a priming fluid, which is not an ink, are needed to provide a fully wetted surface in the printheads and channels and connectors and remove air and any contaminants therefrom, such as, foreign matter, polymer residue and the like. Such a process and fluid will substantially eliminate the entrapment of air, and printing will be even and uniform on the surface being printed from the start of printing and will be applicable for a typical desk top ink jet printer or a large industrial ink jet printer used, for example, to print fabrics or vinyl material using water based inks.

SUMMARY OF THE INVENTION

This invention is directed to a process for priming a passageway to a printhead and the interior of a printhead used in an ink jet printing process to remove air and contaminants therefrom, which comprises the step of passing an aqueous priming fluid through said passageway and into the interior of said printhead, wherein the aqueous priming fluid has an advancing contact angle of less than about 25 degrees and comprises the following:

about 10–90% by weight, based on the total weight of the priming fluid, of at least one polar, water miscible organic solvent having a solubility of at least about 5 parts per 100 parts of water (by weight), such as propylene glycol monopropyl ether, 2-pyrrolidone, dipropylene glycol monomethyl ether, and N-methyl pyrrolidone; and correspondingly about 90–10% by weight, based on the total weight of the priming fluid, of water.

Optionally, the priming fluid may contain in addition one or more of the following additives: an organic water miscible solvent to reduce the freezing temperature, such as glycerol; surfactants to reduce surface tension and enhance wetting of the fluid; defoamers to reduce foaming; hydrotropes; acid or base or buffering agents to maintain the desired pH; colorants to impart color but not adequate to form an ink; polymeric additives; and biocides.

Another part of this invention is the novel priming fluid containing one or more of the above additives. Thus, in another embodiment, the priming fluid comprises:

about 0.1–10% by weight, based on the total weight of the priming fluid, of a surfactant or mixtures of surfactants, such as, a commercially available silicone based surfactant like, Silwet® L77, which is a mixture of a polyalkyleneoxide modified heptamethyltrisiloxane (84%) and allyloxypolyethyleneglycol methyl ether (16%), both based on the weight of the mixture, and about 50–99.9% by weight of water, and preferably 90–99.9% by weight of water, based on the total weight of the priming fluid, with the remainder of the priming fluid (if any) comprising one or more common additives such as polar water miscible organic solvents, organic miscible solvents (for example, to reduce the freezing temperature), defoamers, hydrotropes, acids or bases and/or buffers, polymeric additives, biocides, colorants or fluorescent agents as mentioned above.

These and other features and advantages of the present invention will be more readily understood by those of ordinary skill in the art from a reading of the following detailed description. It is to be appreciated that certain features of the invention which are, for clarity, described above and below in the context of separate embodiments, may also be provided in combination in a single embodiment. Conversely, various features of the invention which are, for brevity, described in the context of a single embodiment, may also be provided separately or in any subcombination. In addition, references to in the singular may also include the plural (for example, "a" and "an" may refer to one, or one or more) unless the context specifically states otherwise.

DETAILED DESCRIPTION OF THE PREFERRED EMBODIMENTS

The present invention provides a process used in ink jet printing and a priming fluid that is used in the process to prime printheads, channels and connectors leading to the printheads to fully wet the interior surface of these components and substantially remove any air and contaminants and foreign matter so that there will be no entrapment of air thereby providing uniform and even printing at the start of the process. Piezo ink jet printheads are a particular problem and require the use of a priming liquid at the start of the printing process. The priming fluid is compatible with the ink jet ink and adequately wets the interior surfaces of the various components used in ink jet printing, preferably has a relatively low freezing point that allows the ink jet printer components, such as, the printheads, to be shipped containing the priming fluid and preferably, has a relatively high flash point so as not to represent a fire or explosion hazard and preferably, is non-toxic.

An important property of the priming fluid is that it is compatible with aqueous ink jet inks, i.e., either pigmented or dye based inks. Any ink introduced into the printer will be in intimate contact with the priming fluid inside the printhead and the fluid must be compatible with the ink, otherwise, the ink can precipitate or increase in viscosity or form gels inside the printhead thus reducing the flow rate of ink through the printhead or partially or completely clog the printhead.

The priming fluid also substantially eliminates air and contaminants from other parts of the printer, such as, the ink feed systems that comprise tubing leading to the ink tanks, to the printer head and to the in-line filters, and valves and removes contaminants from mechanical parts of the printer.

In using the priming fluid, the fluid is introduced into the printhead via openings through which the ink would normally be fed into the printhead. The priming liquid can be fed from a separate container by means of a pump or other pressurized systems. The priming fluid is forced through the entire ink-path of the printhead and overflows through the nozzles of the face of the printhead. In addition to pressurized feeding of the priming fluid through the printhead, the printhead can be activated in either a printing or purging mode to eject the priming fluid.

At the beginning of the printing process, the priming fluid in the printhead is displaced with the ink (pigment or dye based) by pumping the ink through the same inlets as described above. The procedure used to prime the printhead can done when the printhead is not mounted on the printer, but instead, is mounted on a cleaning station comprising brackets to hold the printhead in place, a container of the priming fluid and a feeding mechanism to feed the priming fluid into the printhead. Priming of the printhead can also be done after the printhead is already mounted on the printer. The printheads are connected to the ink tanks via tubing and assisted by pumps. Sufficient quantities of the ink are flushed through the system to displace all of the priming liquid and then printing is initiated.

It is also an option to have the printer equipped with a separate container for ink and another separate container for the priming liquid. Both containers are connected to the printhead with a valve that can direct either priming fluid or ink to the printhead. This allows for the option of priming of the printhead without removal of the printhead from the printer to a separate station.

The priming fluid has a number of uses. The manufacturer of the printhead may charge the printhead with the priming fluid and ship it to customers containing the fluid. Manufacturers of printheads fill printheads with a qualifying liquid to allow for quality testing of the printhead. The qualifying fluid may contain a dye and needs to be removed from the printhead and the printhead cleaned before shipment to a customer. The printhead manufacturer may choose to ship printheads without the priming fluid in which case the customer primes the printed head with the priming fluid before use.

The priming fluid preferably has the following characteristics:

An advancing contact angle of less than about 25 degrees and preferably, less than about 20 degrees and most preferably, less than about 5 degrees on the surface which the liquid would flow through. The advancing contact angle is determined on a stainless steel surface and measured according to the procedure set forth in Chapter 8, page 261 of Polymer Interface and Adhesion, by Souheng Wu, 1982 Marcel Dekker, Inc.

Flash point (determined according to ASTM D-93 Pensky-Martens Closed-Cup) preferably of at least about 60° C. (140° F.).

Preferably, the viscosity is lower than the optimum viscosity recommended for the ink that is to be used, i.e., the viscosity of the priming fluid preferably is lower than the ink that would be optimally fired from the printhead.

A surface tension lower than about 40 dyne/cm, preferably lower than about 30 dyne/cm, is also preferred.

The priming fluid in and of itself is not a printing ink and not useful as an ink jet ink. Any colorants that may be present in the priming fluid are used, for example, for detection or identification purposes.

In one embodiment, the priming fluid contains water and one or more polar water miscible organic solvents.

In this embodiment, the priming fluid contains about 10–90% by weight of water and, preferably, about 40–80% by weight of water, based on the total weight of the priming fluid. The water should be relatively pure and preferably is deionized water, but water from conventional sources can be used. The priming fluid is to be substantially free of particulates and contaminants before being used.

In this embodiment, the priming fluid also contains one or more polar water miscible organic solvents in amounts of about 10–90% by weight, and preferably, about 20–60% by weight, based on the total weight of the priming fluid.

Typically useful polar water miscible organic solvents are aggressive solvents that have a solubility of at least about 5 parts per 100 parts by weight of water and also have an advancing contact angle, measured as above, of less than about 25 degrees which imparts the desired advancing contact angle to the priming fluid.

Of great importance in this embodiment is that the polar solvent is capable of wetting the interior portions of the printhead and printer assembly and remove impurities and entrapped air. One or more of these polar solvents may also act as a compatibilizing agent for all of the components of the fluid. Typically useful polar solvents are 2-pyrrolidone, ethylene glycol monobutyl ether, ethylene glycol dibutyl ether, ethylene glycol monoethyl ether, ethylene glycol monomethyl ether, ethylene glycol monophenyl ether, ethylene glycol monohexyl ether and other mono and dialkyl ethers of ethylene glycol, N-methyl pyrrolidone, propylene glycol monopropyl ether, dipropylene glycol monomethyl ether, tetrahydrofuran and diethyl ether, isopropanol, n-propanol, methanol, and water-miscible ketones, such as, acetone.

Preferred polar solvents are as follows: propylene glycol monopropyl ether, 2-pyrrolidone, dipropylene glycol monomethyl ether, and N-methyl pyrrolidone.

In addition, the priming fluid may also contain an organic miscible solvent that reduces the freezing point of the priming fluid in the event the polar solvent does not decrease the freezing point to the desired level. The organic miscible solvents may be used in amounts up to about 50% by weight, more preferably about 5–50% by weight, and still more preferably about 5–25% by weight, based on the total weight of the priming fluid. Typically useful organic miscible solvents are glycerol, ethoxylated glycerol and sugars, such as, sorbitol.

The priming fluid may also contain in addition up to about 10% by weight, and preferably from about 0.1–10% by weight, based on the total weight of the priming fluid, of a surfactant to reduce the surface tension of the fluid and enhance wetting of surfaces. Useful surfactants may be ionic, nonionic, cationic, or amphoteric. A requirement of the surfactant is that is must be compatible with the other components of the priming fluid and with inks that are to be subsequently introduced. Surfactants may be selected from a broad range of hydrocarbon-based, silicone-based or fully- or partially-fluorinated surfactants such as, but not limited to, BYK®-345, BYK®. 348 (Byk Chemie, Wallingford, Conn.), Silwet® 7608, Silwet® 7602, Silwet® L77 (CK Witco, Greenwhich, Conn.), Surfynol® 440, Surfynol® 104, (Air Products, Allentown, Pa.), Aerosol® OT (Cytec Industries, West Paterson N.J.), Zonyl® FSO-100, Zonyl® FSD, Zonyl® FSK, and Zonyl® FSA (DuPont, Deepwater N.J.).

The priming fluid also may contain in addition up to about 0.5% by weight, and preferably about 0.05–0.5% by weight, based on the total weight of the priming fluid, of defoamers to reduce foaming, such as, Surfynol® DF-659, Surfynol® DF-58, Surfynol® DF-66 (all from Air Products, Allentown Pa.), Foammaster® (from Henkel, Ambler, Pa.), BYK®-019, BYK®-021, BYK®-022, BYK®-025 (all from Byk Chemie, Wallingford, Conn.).

In addition, the priming fluid may contain up to about 15% by weight, and preferably about 0.1–15% by weight, based on the total weight of the priming fluid, of a hydrotrope to increase the solubility of some soluble organic solvents in water at elevated temperatures. Typical hydrotropes that can be used are as follows: sodium xylene sulfonate, sodium toluene sulfonate, sodium cumene sulfonate, sodium ethylhexyl sulfate, alkyl naphthalene sodium sulfate, and alkyl sulfonated diphenyl oxide disodium salt.

The priming fluid may contain acids, bases and/or buffers to maintain the desired pH. Typical acids that can be used are phosphoric acid, phosphonic acid, sulfuric acid, hydrochloric acid, nitric acid, citric acid, acetic acid and sulfamic acid. Typical bases that can be used are ammonium hydroxide, potassium hydroxide, sodium hydroxide or lithium hydroxide; pyridine; mono- di- or tri-ethanolamine; dimethyl ethanol amine; mono-, di- or tri-ethylamine; morpholine; n-methyl morpholine and the like.

The priming fluid can contain polymeric additives, such as, random and structured polymers, and/or soluble, dispersed and emulsified polymeric dispersants, like microgels. These polymers can be acrylamides, methacrylamides, acrylics, styrene, methyl styrene, vinyl acetate, vinyl alcohols or any combinations thereof with or without added crosslinkers such as those that are well known in the art. The polymeric additive may be synthetic or available from natural sources, such as, xanthan gum, polysaccharides and alginates. The polymeric additives may be ionic, non ionic, cationic or amphoteric in nature. The type, structure, and amount of such polymeric additives are selected for their impact on viscosity and stability of the priming liquid and the final compatibility with other components of the priming solution as well as compatibility with any other liquid or ink that the priming liquid is likely to come into contact with during its use.

The priming fluid can contain effective amounts of biocides to inhibit growth of micro-organisms. Typical biocides that can be used are Dowicides® (Dow Chemical, Midland, Mich.), Nuosept® (Huls America, Inc., Piscataway, N.J.), Omidines®(Olin Corp., Cheshire, Conn.), Nopcocides® (Henkel Corp., Ambler, Pa.), Troysans® (Troy Chemical Corp., Newark, N.J.) and sodium benzoate.

Optionally, colorants or fluorescent agents may be used to serve as a tracer of the priming liquid. The preferred amount would be a minimum amount so as not to cause contamination of the color values of the inks intended for use in a printing process. Colorants can be selected from a broad group of dyes or pigments, such as, but not limited to those disclosed in U.S. Pat. No. 5,555,008 and U.S. Pat. No. 5,518,534, which are hereby incorporated by reference for all purposes as if fully set forth. In any event, colorants are not added in sufficient quantity to make the priming liquid useful as an ink jet printing ink.

One preferred priming fluid contains about 40–80% by weight water, about 2–10% by weight 2-pyrrolidone, about 10–25% by weight of propylene glycol monopropyl ether, and about 10–30% by weight of glycerol. One particularly preferred composition contains the aforementioned components in a weight ratio of about 60/5/15/20, respectively.

In another embodiment of the present invention, a priming fluid can be formulated using a surfactant, such as those listed above, and water provided that an advancing contact angle of less than about 25 degrees can be obtained but without the use of a polar water miscible solvent in the amounts referred to above. A typical priming fluid that does not contain the polar water miscible solvent in the aforementioned amounts comprises about 0.1–10% by weight, based on the total weight of the priming fluid, of a surfactant or mixtures of surfactants, such as, a commercially available silicone based surfactant like, Silwet® L77, which is a mixture of a polyalkyleneoxide modified heptamethyltrisiloxane (84%) and allyloxypolyethyleneglycol methyl ether (16%), both based on the weight of the mixture, and about 50–99.9% by weight of water, and preferably 90–99.9% by weight of water, based on the total weight of the priming fluid. Preferably deionized water is used. Such a priming fluid also can contain organic miscible solvents to reduce the freezing temperature, defoamers, hydrotropes, acids or bases and/or buffers, polymeric additives, biocides, colorants or fluorescent agents in the amounts as discussed hereinbefore and hereinafter.

The invention will now be further illustrated by, but not limited to, the following examples, in which parts and percentages are by weight unless otherwise noted.

EXAMPLES

The following constituents were charged into a mixing vessel and blended together as required to form a priming fluid for each example:

| | | Parts by Weight |
|---|---|---|
| Ex. A | Deionized Water | 100 |
| Ex. B | Ethanol | 100 |
| Ex. C | Isopropanol | 100 |
| Ex. 1 | Dipropylene glycol monomethyl ether | 35 |
| | BYK ®-345 | 2 |
| | Deionized Water | 65 |
| Ex. 2 | Dipropylene glycol monomethyl ether | 40 |
| | Isopropanol | 40 |
| | Deionized Water | 20 |

-continued

| | | Parts by Weight |
|---|---|---|
| Ex. 3 | Propylene glycol monopropyl ether | 20 |
| | Gylcerol | 20 |
| | Deionized Water | 60 |
| Ex. 4 | Glycerol | 20 |
| | Diethylene glycol | 10 |
| | Silwet ® 7608 | 0.3 |
| | Surfynol ® DF-695 | 0.02 |
| | Deionized Water | 69.68 |
| Ex. 5 | 2-Pyrrolidone | 5 |
| | Propylene glycol monopropyl ether | 15 |
| | Glycerol | 20 |
| | Deionized Water | 60 |
| Ex. 6 | Propylene glycol monopropyl ether | 20 |
| | Deionized Water | 80 |
| Ex. 7 | 2-Pyrrolidone | 5 |
| | Propylene glycol monopropyl ether | 15 |
| | Propylene glycol monomethyl ether | 5 |
| | Glycerol | 20 |
| | Deionized water | 55 |
| Ex. 8 | 2-Pyrrolidone | 5 |
| | Propylene glycol monopropyl ether | 15 |
| | Propylene glycol monomethyl ether | 10 |
| | Glycerol | 20 |
| | Deionized water | 50 |
| Ex. 9 | 2-Pyrrolidone | 5 |
| | Propylene glycol monopropyl ether | 15 |
| | Propylene glycol monomethyl ether | 15 |
| | Glycerol | 20 |
| | Deionized Water | 45 |
| Ex. 10 | Silwet ® L77 | 3 |
| | Deionized water | 97 |

For each of the above Examples, the Advancing Contact Angle was determined by using the procedure as described in the specification. Example A priming fluid has an advancing contact angle substantially above 25 degrees. The priming fluids of Examples B and C and Examples 1–10, each have an advancing contact angle below 25 degrees. The polar solvents used in these priming fluids have a water solubility of at least 5 parts per 100 parts of water. Examples of the advancing contact angles of several Examples and liquids are listed in the following Table 1.

TABLE 1

| | Advancing Contact Angle | Wetting Characteristics |
|---|---|---|
| Ex. 4 | 0 degree | Most Preferred |
| Ex. 5 | 15 degrees | Preferred |
| Ex. 7 | 20 degrees | Preferred |
| Ex. 8 | 0 degree | Most Preferred |
| Ex. 9 | 13 degrees | Preferred |
| Ex. 10 | 0 degree | Most Preferred |
| Propylene glycol monopropyl ether | 0 degree | Most Preferred |
| Propylene glycol | 24 degrees | Marginal |
| Glycerol | 70 degrees | Not Preferred |
| Diethylene Glycol | 31 degrees | Not Preferred |
| Ethylene Glycol | 35 degrees | Not Preferred |

The compatibility of these priming fluids of Examples A–C and 1–6 with a green pigmented ink jet ink that typically is used for ink jet ink printers was evaluated by blending three different weight/weight ratios of the priming fluids with the ink. The green ink had a viscosity of about 15 centipoise, surface tension of around 34 dynes/cm and pH of 8.5.

Severe incompatibility between the liquid and ink will result in formation of precipitants in the ink. Such occurrence of precipitation is a basis for the rejection of a priming fluid.

The compatibility test data are shown in Table 2 below.

TABLE 2

| | Precipitation at 90:10 liquid:ink | Precipitation at 50:50 liquid:ink | Precipitation at 10:90 liquid:ink |
|---|---|---|---|
| Ex. A | No | No | No |
| Ex. B | No | Yes | Yes |
| Ex. C | No | Yes | Yes |
| Ex.1 | No | No | No |
| Ex.2 | No | No | No |
| Ex.3 | No | No | No |
| Ex.4 | No | No | No |
| Ex.5 | No | No | No |
| Ex.6 | No | No | No |

Examples B and C exhibited incompatibility with the ink and were not considered suitable as priming fluids.

The above prepare priming fluids were tested for the removal of air from a printhead using the following test procedure:

A Spectra NOVA-Q printhead (Hanover, N.H.) filled with air was primed, separately, with 100 mL of each of the priming fluids of Example A and Examples 1–10. Examples B and C were not tested since these fluids caused the ink to precipitate. The priming fluids were pumped through the printhead through the ink outlet and collected in a waste container after exit from the nozzles in the nozzle plate of the printhead. The primed head was then filled with green pigmented ink.

The ink was purged from the printhead for 5 seconds during which about 20 ml of ink was displaced from the printhead. A nozzle check pattern was printed onto a piece of paper by printing the printhead. The number of nozzles that were not firing because of air entrapment was noted. This 5 second ink purge followed by a nozzle check was repeated four more times. Each time, the number of nozzles clogged by entrapped air was noted. The results are summarized in Table 3.

TABLE 3

Number of Nozzles (out of total of 256 per printhead) Clogged by Air

| | Cycle 1 | Cycle 2 | Cycle 3 | Cycle 4 | Cycle 5 |
|---|---|---|---|---|---|
| Ex.A | 69 | 32 | 26 | 25 | 24 |
| Ex.1 | 0 | 0 | 0 | 0 | 0 |
| Ex.2 | 0 | 0 | 0 | 0 | 0 |
| Ex.3 | 0 | 0 | 0 | 0 | 2 |
| Ex.4 | 21 | 2 | 0 | 0 | 0 |
| Ex.5 | 6 | 6 | 6 | 6 | 6 |
| Run 1 | | | | | |
| Run 2 | 5 | 0 | 10 | 1 | 0 |
| Ex.6 | 4 | 3 | 3 | 4 | 3 |
| Ex.7 | 0 | 0 | 0 | 0 | 0 |
| Ex.8 | 3 | 3 | 5 | 3 | 3 |
| Ex.9 | 8 | 4 | 3 | 4 | 1 |
| Ex.10 | 2 | 2 | 1 | 6 | 1 |

All of the above priming fluids of Examples 1–10 are acceptable for use as a priming fluid in an ink jet printer and ink jet printheads. Comparative Example A because of the high level of clogging by air is not acceptable as a priming fluid.

What is claimed is:

1. An improved ink jet ink printing process for priming passage ways to printhead(s) and the interior of printhead(s) used in an ink jet printing process to remove air and contaminants therefrom, which comprises the step of passing an aqueous priming fluid through said passages and into the interior of the printhead(s), wherein the improvement comprises that the aqueous priming fluid has an advancing contact angle of less than about 25 degrees and comprises the following:

about 10–90% by weight, based on the total weight of the priming fluid, of at least one polar, water miscible organic solvent having a solubility of at least about 5 parts per 100 parts of water (by weight), and correspondingly, about 90–10% by weight, based on the total weight of the priming fluid, of water.

2. The process of claim 1 in which the polar water miscible organic solvent has an advancing contact angle of less than about 25 degrees.

3. The process of claim 2 in which the polar water miscible organic solvent is selected from the group consisting of propylene glycol monopropyl ether, 2-pyrrolidone, dipropylene glycol monomethyl ether, and N-methyl pyrrolidone.

4. The process of claim 3 in which the polar water miscible organic solvent is mixture of propylene glycol monopropyl ether and 2-pyrrolidone.

5. The process of claim 1 in which the priming fluid comprises in addition about 5–50% by weight, based on the total weight of the priming fluid, of an organic water miscible solvent that reduces the freezing temperature of the fluid.

6. The process of claim 1 in which the priming fluid comprises in addition about 0.1–10% by weight, based on the total weight of the priming fluid, of a surfactant to reduce the surface tension of the priming fluid and enhance wetting of the fluid.

7. The process of claim 1 in which the priming fluid further comprises about 0.05–0.5% by weight, based on the total weight of the priming fluid, of a defoamer.

8. The process of claim 1 in which the priming fluid further comprises about 0.1–15% by weight, based on the total weight of the priming fluid, of a hydrotrope.

9. The process of claim 1 in which the priming fluid further contains an acid, base or buffering agent.

10. The process of claim 1 in which the priming fluid further contains a polymeric additive.

11. The process of claim 1 in which the priming fluid further contains a biocide.

12. A priming fluid having an advancing contact angle of less than about 25 degrees and comprises:

a. about 20–60% by weight, based on the total weight of the priming fluid, of at least one polar water miscible solvent having a water solubility of at least 5 parts per 100 parts of water (by weight);

b. about 5–25% by weight, based on the total weight of the priming fluid, of a water miscible organic solvent to reduce the freezing temperature of the priming fluid; and c. about 40–80% by weight, based on the total weight of the priming fluid, of water.

13. The priming fluid of claim 12 in which the polar water miscible organic solvent has an advancing contact angle of less than about 25 degrees.

14. The priming fluid of claim 13 in which the polar water organic miscible solvent is selected from the group consisting of propylene glycol monopropyl ether, 2-pyrrolidone, dipropylene glycol monomethyl ether, and N-methyl pyrrolidone.

15. The priming fluid of claim 14 in which the polar water miscible organic solvent comprises a mixture of propylene glycol monopropyl ether and 2-pyrrolidone.

16. A priming fluid having an advancing contact angle of less than about 25 degrees and comprises:

a. about 0.1–10% by weight, based on the total weight of the priming fluid, of at least one surfactant comprising an organosilicone based surfactant, and b. about 50–99.9% by weight, based on the total weight of the priming fluid, of water, with the remainder being one or more other additives.

17. The priming fluid of claim 16 containing in addition an organic water miscible solvent that reduces the freezing temperature of the fluid.

18. The priming fluid of claim 16 containing from about 90–99.9% water.

19. A priming fluid having an advancing contact angle of less than about 25 degrees and comprises:

a. about 0.1–10% by weight, based on the total weight of the priming fluid, of at least one surfactant, and b. about 50–99.9% by weight, based on the total weight of the priming fluid, of water, with the remainder being one or more other additives comprising an organic water miscible solvent that reduces the freezing temperature of the fluid.

20. The priming fluid of claim 19 containing from about 90–99.9% water.

* * * * *